US007503832B1

(12) United States Patent
Chang

(10) Patent No.: US 7,503,832 B1
(45) Date of Patent: Mar. 17, 2009

(54) LINEAR SANDER

(76) Inventor: Wen-Chi Chang, No. 48, Lane 276, Guangfu Rd., Shengang Hsiang, Taichung Hsien (TW)

( * ) Notice: Subject to any disclaimer, the term of this patent is extended or adjusted under 35 U.S.C. 154(b) by 0 days.

(21) Appl. No.: 12/014,515

(22) Filed: Jan. 15, 2008

(51) Int. Cl.
*B24B 7/06* (2006.01)

(52) U.S. Cl. ..... 451/11; 451/65; 451/57

(58) Field of Classification Search ..... 451/65, 451/59, 57, 130, 131, 124, 184, 5, 11
See application file for complete search history.

(56) References Cited

U.S. PATENT DOCUMENTS 3,032,931 A * 5/1962 Eversole ..... 451/121
5,531,636 A * 7/1996 Bissen ..... 451/130
7,125,323 B1 * 10/2006 Chuang ..... 451/130
7,351,130 B1 * 4/2008 Chang ..... 451/11

* cited by examiner

*Primary Examiner*—Robert Rose
(74) *Attorney, Agent, or Firm*—Hershkovitz & Associates, LLC; Abe Hershkovitz

(57) ABSTRACT

A linear sander has a base, at least one rough abrasive assembly, at least one fine abrasive assembly and a reciprocating device. The base has two sides and a belt. Each rough abrasive assembly is mounted on the base above the belt and has a rotating axle and an abrasive brush mounted around the rotating axle. Each fine abrasive assembly is rotatable mounted on the base is aligned obliquely to the mounting shafts and has two mounting brackets, two mounting shafts and multiple abrasive rollers. The reciprocating device is connected to the abrasive assembly and has a pivot bracket mounted securely on one of the mounting brackets, two drive bars mounted on move the abrasive rollers linearly along the mounting shafts and a linear driver connected to the drive bar.

12 Claims, 11 Drawing Sheets

LINEAR SANDER

BACKGROUND OF THE INVENTION

1. Field of the Invention

The present invention relates to a sander and more particularly to a linear sander that can simultaneously move an abrasive assembly reciprocatorily and rotatably to sand or polish an object and can adjust the distance between the sander and the surfaces of the article to provide different polishing results.

2. Description of Related Art

A conventional linear sander is usually used to smooth surfaces of an article for finishing or polishing finished surfaces and has a base, a conveyor belt, two axles, a driver and an abrasive brush. The conveyor belt is mounted in the base. The axles are rotatably mounted through the base in parallel above the conveyor belt. The driver is mounted on the base and rotates at least one of the axles. The abrasive brush is mounted around and rotated by the axles to sand surfaces of an object abutting the abrasive brush. However, unstable movement of the rotating abrasive brush of the conventional sander causes inconsistency of finish on the article. Therefore, the conventional linear sander cannot provide a fine finish to the article, and the fine finish must be achieved by other means such as using disc sanders or manual hand sanding.

Another conventional linear sander has two abrasive assemblies to smooth surfaces of an article, one of the abrasive assemblies is set obliquely above the conveyor belt and the other abrasive assembly is set parallelly above the conveyor belt to provide different polishing directions. However, the conventional linear sander can improve the polishing effect, but cannot polish surfaces of the article reciprocatorily.

To overcome the shortcomings, the present invention provides a linear sander to mitigate or obviate the aforementioned problems.

SUMMARY OF THE INVENTION

The main objective of the invention is to provide a linear sander that can move an abrasive assembly reciprocatorily and rotatably at the same time to provide a preferred polishing effect.

The linear sander in accordance with the present invention has a base, at least one rough abrasive assembly, at least one fine abrasive assembly and a reciprocating device. The base has two sides and a belt. Each rough abrasive assembly is mounted on the base above the belt and has a rotating axle and an abrasive brush mounted around the rotating axle. Each fine abrasive assembly is rotatably mounted on the base is aligned obliquely to the mounting shafts and has two mounting brackets, two mounting shafts and multiple abrasive rollers. The reciprocating device is connected to the abrasive assembly and has a pivot bracket mounted securely on one of the mounting brackets, two drive bars to the abrasive rollers to move the abrasive rollers linearly along the mounting shafts and a linear driver connected to the drive bar.

Other objects, advantages and novel features of the invention will become more apparent from the following detailed description when taken in conjunction with the accompanying drawings.

DETAILED DESCRIPTION OF PREFERRED EMBODIMENT

Figure 1:
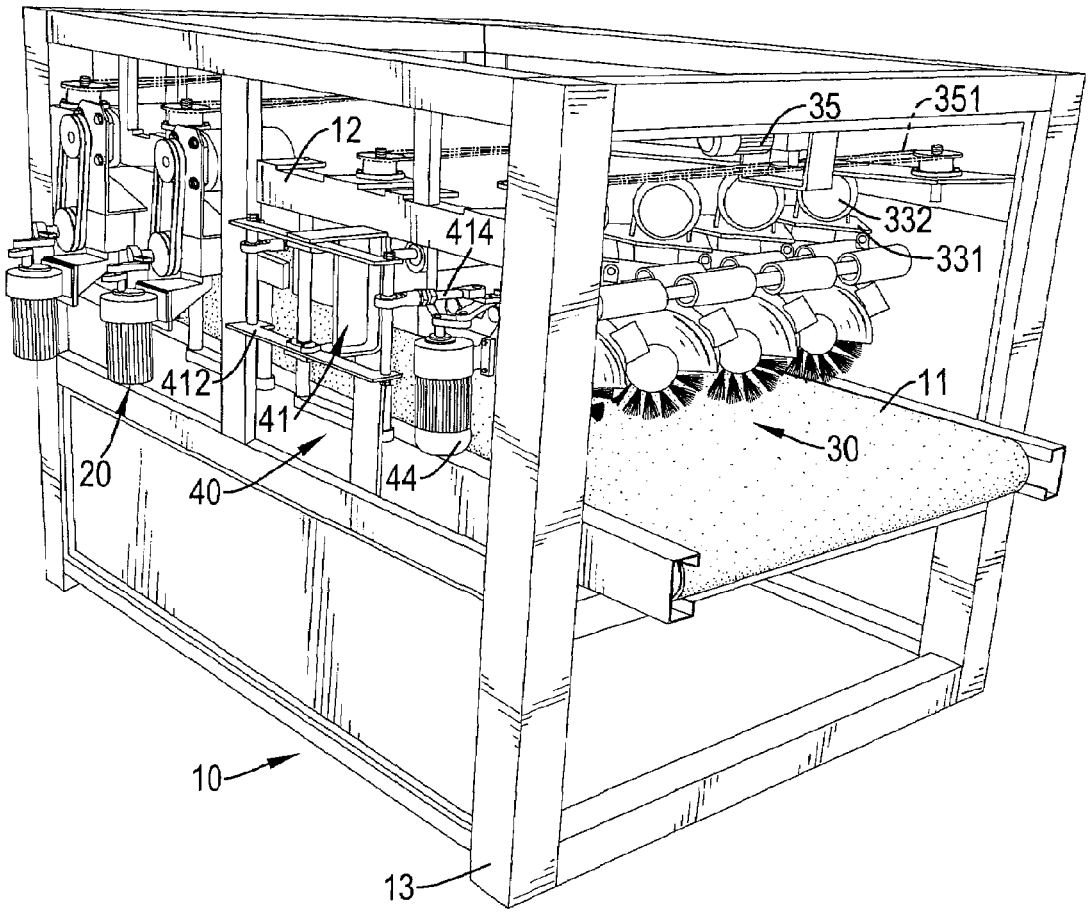
FIG. 1 is a perspective rear view of a linear sander in accordance with the present invention.

With reference to FIG. 1, a linear sander in accordance with the present invention has a base (10), at least one rough abrasive assembly (20), at least one fine abrasive assembly (30) and a reciprocating device (40).

The base (10) has a top, a bottom, a front end, a rear end, two longitudinal sides, at least four stanchions (13), at least two crossbars (12) and a conveyor belt (11). Each crossbar (12) is mounted between two different stanchions (13) on the longitudinal sides of the base (10). The conveyor belt (11) is movably mounted in the base (10) between the longitudinal sides.

Figure 2:
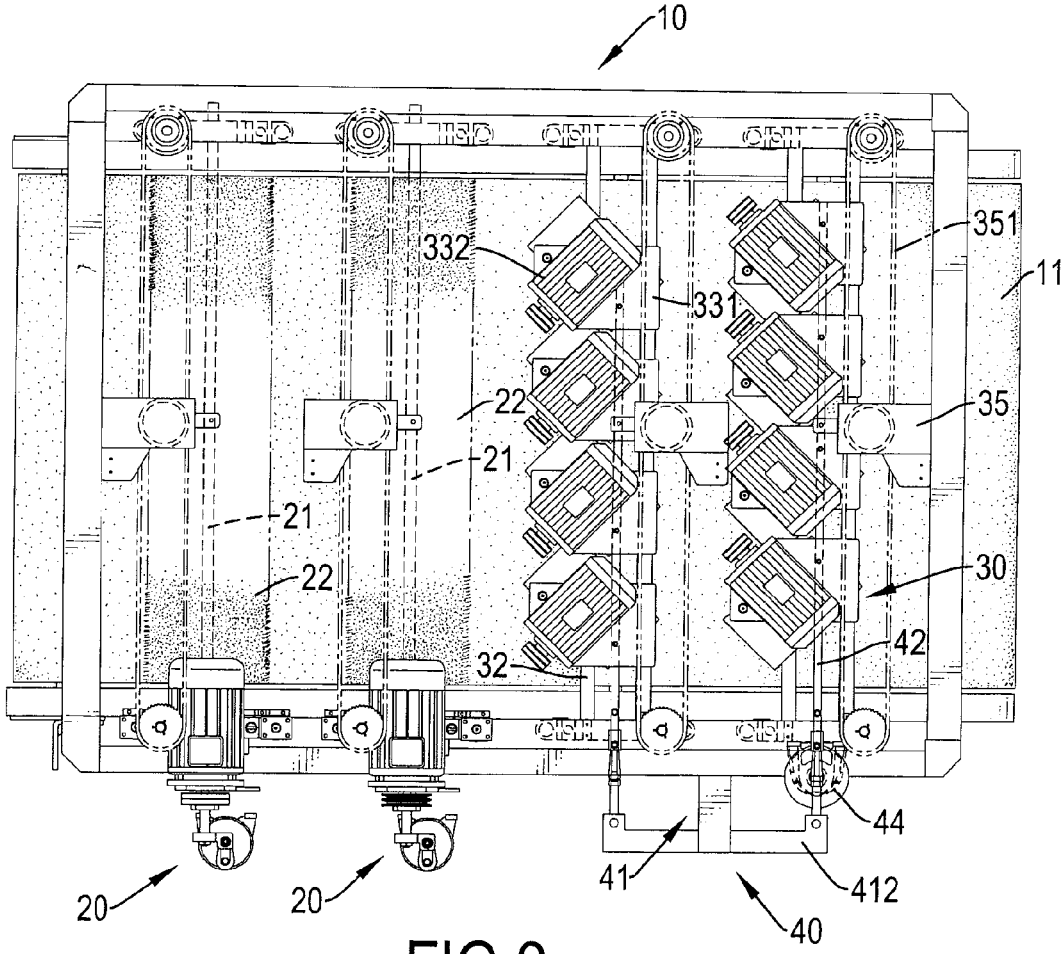
FIG. 2 is a top view of the linear sander in FIG. 1, internal elements shown in phantom lines.
Figure 3:
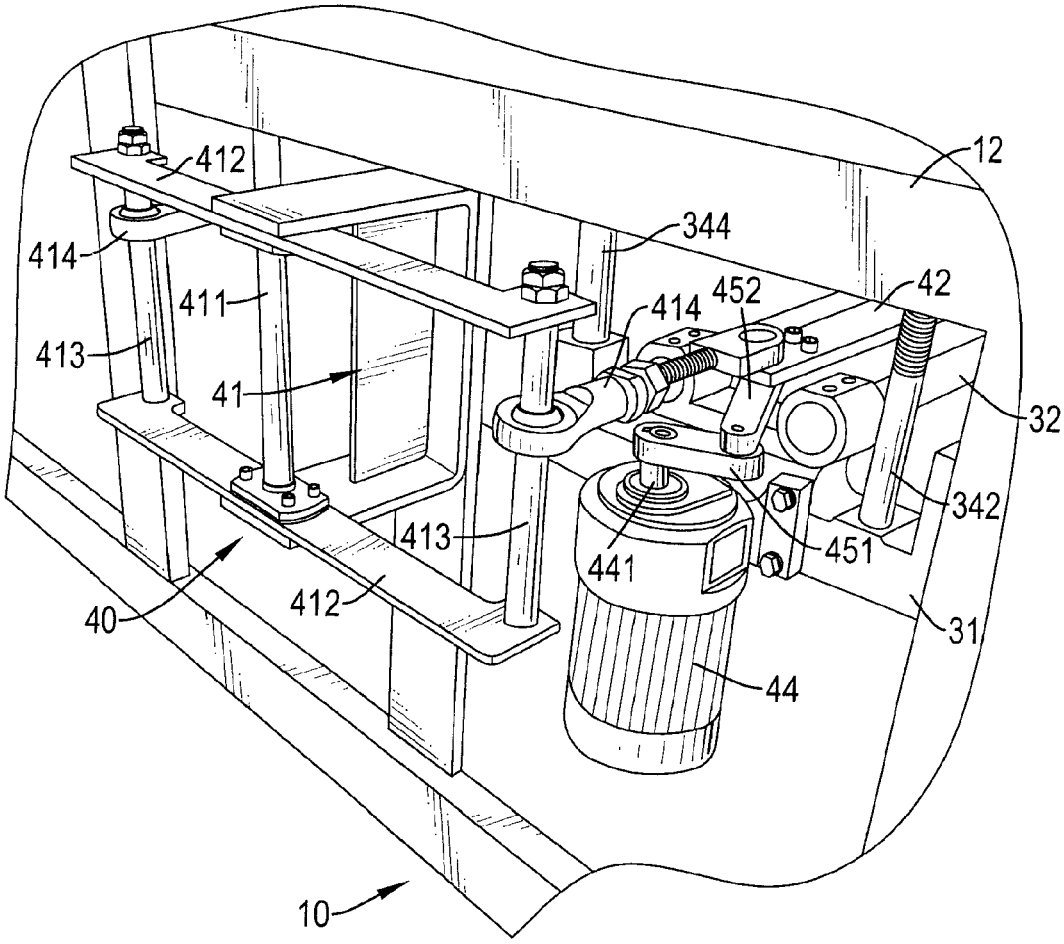
FIG. 3 is an enlarged perspective rear view of a reciprocating device of the linear sander in FIG. 1.
Figure 4:
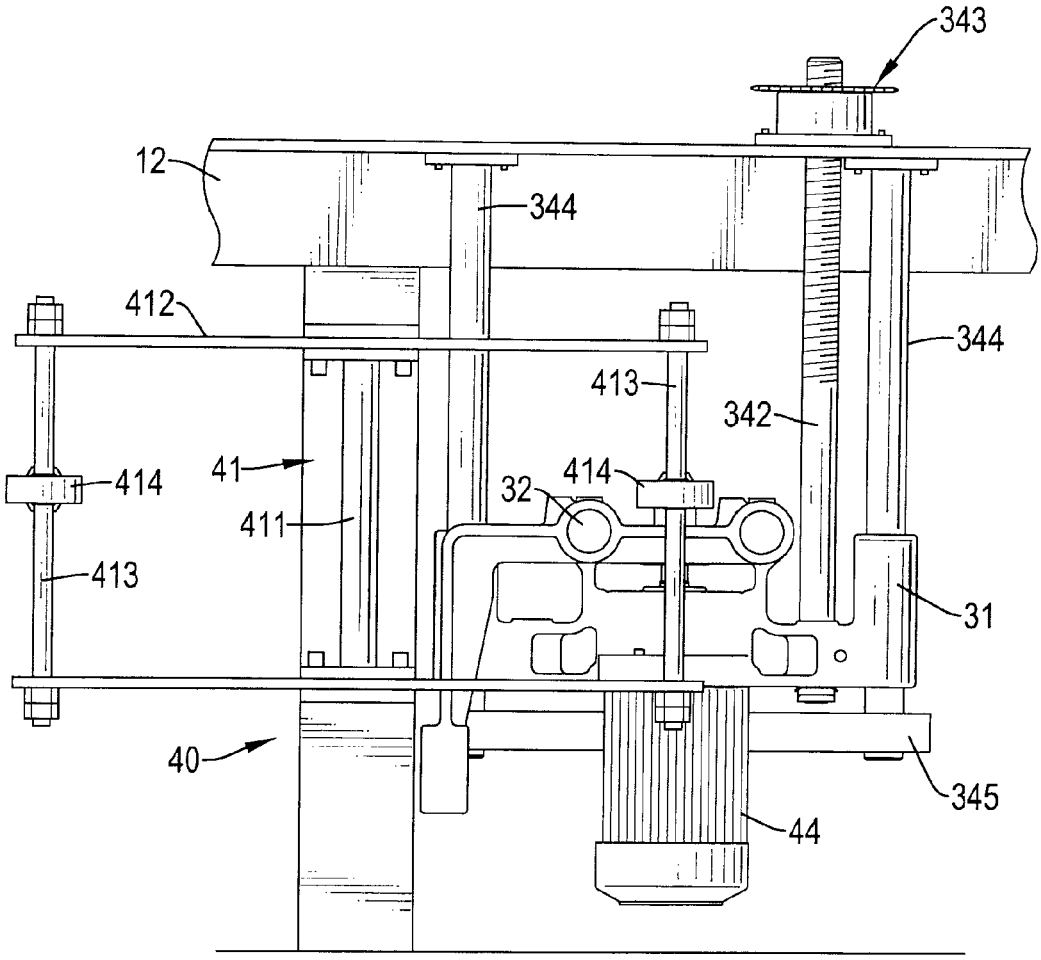
FIG. 4 is an enlarged side view of the reciprocating device of the linear sander in FIG. 3.
Figure 5:
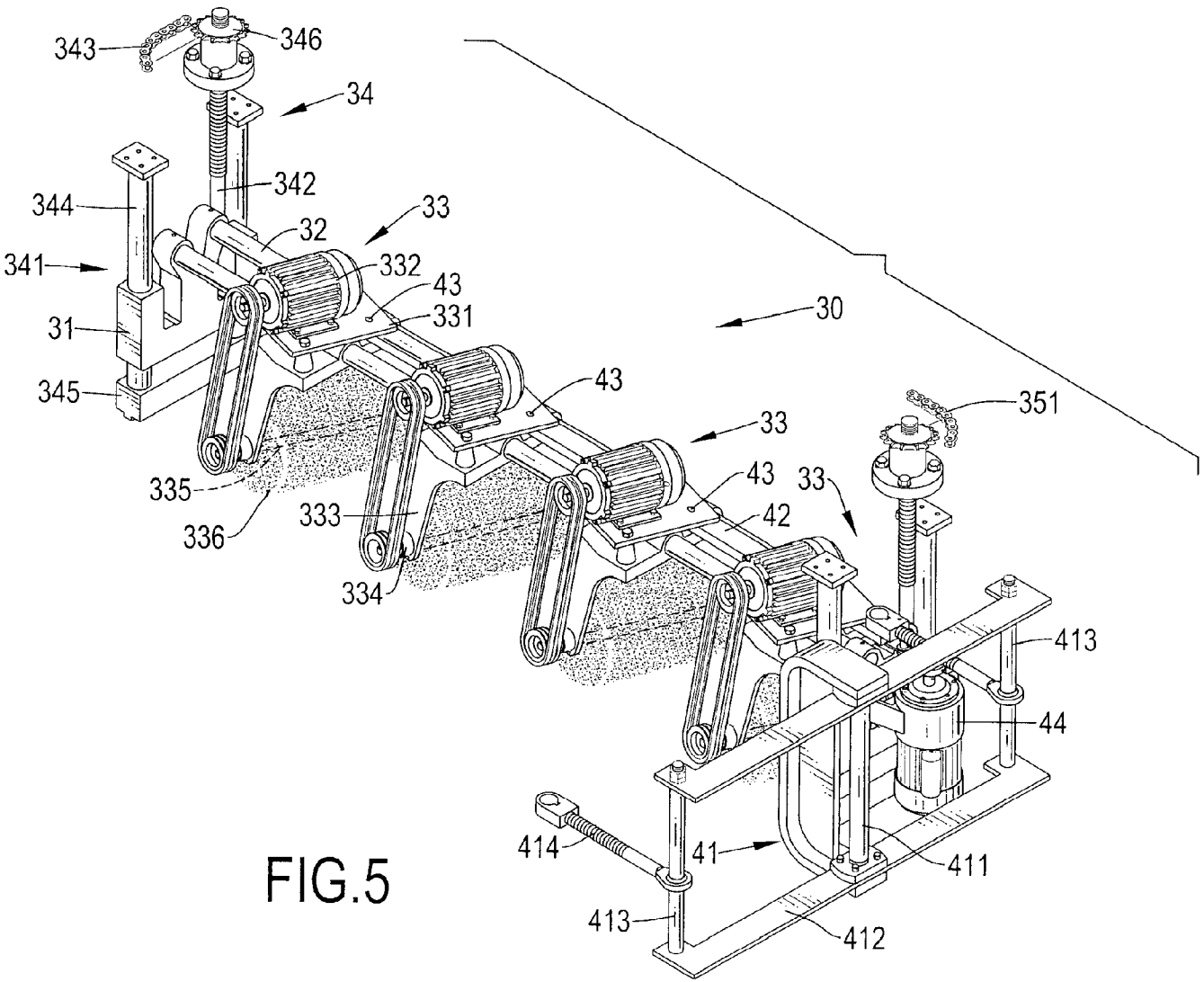
FIG. 5 is an enlarged perspective view in partial section of the linear sander in FIG. 1.

With further reference to FIG. 2, each rough abrasive assembly (20) is rotatably mounted on the front end of the base (10) above the conveyor belt (11) and has a rotating axle (21) and an abrasive brush (22). The rotating axle (21) is rotatably mounted between the longitudinal sides of the base (13) above the conveyor belt (11). The abrasive brush (22) is mounted around the rotating axle (21) to polish surfaces of an article mounted on the belt (11) and may be sand cloth or the like.

With further reference to FIGS. 5, 6, 8 and 10, two fine abrasive assemblies (30) may be implemented and operated in opposite directions, and each fine abrasive assembly (30) is mounted on the rear end of the base (10) and has two mounting brackets (31), two mounting shafts (32), multiple abrasive rollers (33), two optional clearance adjustors (34) and an optional adjustor driver (35).

The mounting brackets (31) are mounted adjacent to the longitudinal sides of the base (10), may be mounted movably on the crossbars (12) of the base (10) and each mounting bracket (31) has an inner side, an outer side and a middle.

The mounting shafts (32) are mounted parallelly to the middles of the mounting brackets (31) and each mounting shaft (32) has two ends.

The abrasive rollers (33) are slidably mounted separately and equi-spaced on the mounting shafts (32) and each abrasive roller (33) has a base frame (331), a motor (332), an axle mount (333), an optional bearing (334), a rotating axle (335) and an abrasive brush (336).

The base frame (331) is slidably mounted on the mounting shafts (32) between the mounting brackets (31) and has a top and a bottom.

The motor (332) is securely mounted on the top of the base frame (331), may be aligned obliquely to the mounting shafts (32) and the fine abrasive assemblies (30) may be rotated in different directions by the motor (332) to polish the surfaces of the article completely.

The axle mount (333) is mounted on the bottom of the base frame (331) and has a free end.

The bearing (334) is mounted in the free end of the axle mount (333).

The rotating axle (335) is rotatably mounted through the free end of the axle mount (22), may be through the bearing (334), is mounted above the conveyor belt (11) and has a drive end and a central segment. The drive end of the rotating axle (335) is mounted through the bearing (334) and is rotated by the motor (332).

The abrasive brush (336) is mounted around the central segment of the rotating axle (335) to polish surfaces of an article mounted on the conveyor belt (11), and may be a sand cloth.

The clearance adjustors (34) are respectively connected to the base (10) and the ends of the mounting shafts (32) to allow the fine abrasive assemblies (30) to be moved perpendicularly relative to the conveyor belt (11) and each clearance adjustor (34) has a guide frame (341), an adjustor shaft (342), and an adjustor pulley (343).

The guide frame (341) is mounted on one side of the base (10) and through a corresponding mounting bracket (31) of the first abrasive assembly (30) and has two guiding shafts (344) and a stopping block (345). The guiding shafts (344) are vertically and securely mounted on the side of the base (10) and through the corresponding mounting bracket (31) and each guiding shaft (344) may be connected to one of the crossbars (12) of base (10) and have a distal end. The stopping block (345) is mounted on the guiding shafts (344) to limit movement of the mounting bracket (31) along the guiding shafts (344) and may be mounted between the distal ends of the guiding shafts (344).

The adjustor shaft (342) is mounted securely on the mounting bracket (31), parallel to the guiding shafts (344) and has a connecting end, a distal end and an external thread. The connecting end of the adjustor shaft (342) is mounted securely on the mounting bracket (31). The external thread is formed around the adjustor shaft (342) near the distal end.

The adjustor pulley (343) is rotatably mounted on the distal end of the adjustor shaft (342), engages the external thread of the adjustor shaft (342), and has an annular surface and multiple teeth (346) formed on the annular surface. Therefore, rotating the adjustor pulley (343) moves the adjustor shafts (342) of the clearance adjustors (34), up or down through the adjustor pulley (343) causing the mounting brackets (31) to slide along the guiding shafts (344) to change a distance between the abrasive brushes (336) and surfaces of the article to provide different polishing results.

The adjustor driver (35) is mounted on the top of the base (10) between the guide frames (341) and has a chain (351) that engages the teeth (346) of the adjustor pulleys (343). The chain (351) of the adjustor driver (35) rotates the adjustor pulleys (343) synchronously to move the adjustor shaft (342) through the adjustor pulley (343). Therefore, the mounting bracket (31) will move the mounting shafts (32) perpendicularly relative to the conveyor belt (11).

With further reference to FIGS. 3, 4, 6, 7, 8, 9 and 10, the reciprocating device (40, 40A, 40B, 40C) is connected to the at least one fine abrasive assembly (30) and may be connected to the rough abrasive assembly (20) to move the abrasive rollers (33) of the abrasive assembly (30, 20) reciprocatorily and linearly may be along the mounting shafts (32) and has a pivot bracket (41, 41A, 41B, 41C), two drive bars (42, 42A, 42B, 42C), multiple optional connecting bolts (43, 43A, 43B, 43C), a linear driver (44, 44A, 44B, 44C) and an optional linking segment (45, 45A, 45B, 45C).

The pivot bracket (41, 41A, 41B, 41C) may be U-shaped, is mounted securely on the base (10) near one of the crossbars (12) and has a top, a bottom, a pivot shaft (411, 411A, 411B, 411C), at least one pivot arm (412, 412A, 412B, 412C), two guiding posts (413, 413A, 413B, 413C) and two couples (414, 414A, 414B, 414C).

The pivot shaft (411, 411A, 411B, 411C) is connected to the pivot bracket (41, 41A, 41B, 41C) between the top and the bottom.

The at least one pivot arm (412, 412A, 412B, 412C) is respectively mounted rotatably and transversally on the top and the bottom of the pivot bracket (41, 41A, 41B, 41C) parallel to the crossbars (12) of the base (10), are connected to the pivot shaft (411, 411A, 411B, 411C) and each pivot arm (412, 412A, 412B, 412C) has a middle and two free ends. The middles of the pivot arms (412, 412A, 412B, 412C) are connected to the pivot bracket (41, 41A, 41B, 41C) and the pivot shaft (411, 411A, 411B, 411C).

The guiding posts (413, 413A, 413B, 413C) are securely connected respectively to two free ends of the pivot arms (412, 412A, 412B, 412C), parallel to the pivot shaft (411, 411A, 411B, 411C).

The couples (414, 414A, 414B, 414C) are respectively mounted around the guiding posts (413, 413A, 413B, 413C) and each couple (414, 414A, 414B, 414C) has a mounting end and a driving end. The mounting ends of the couples (414, 414A, 414B, 414C) are respectively mounted around the guiding posts (413, 413A, 413B, 413C).

Figure 6:
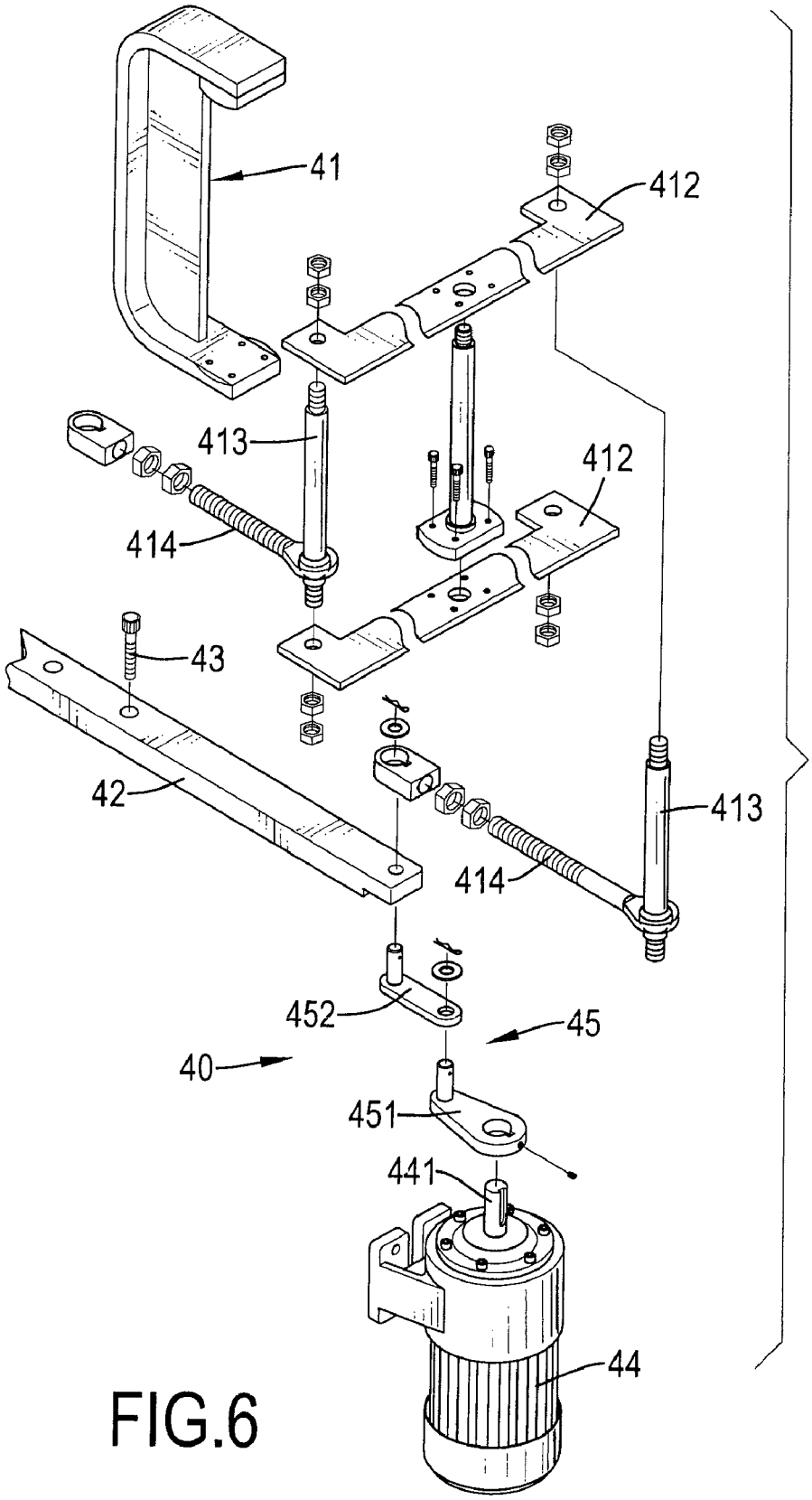
FIG. 6 is an exploded perspective view in partial section of the reciprocating device in FIG. 3.
Figure 7:
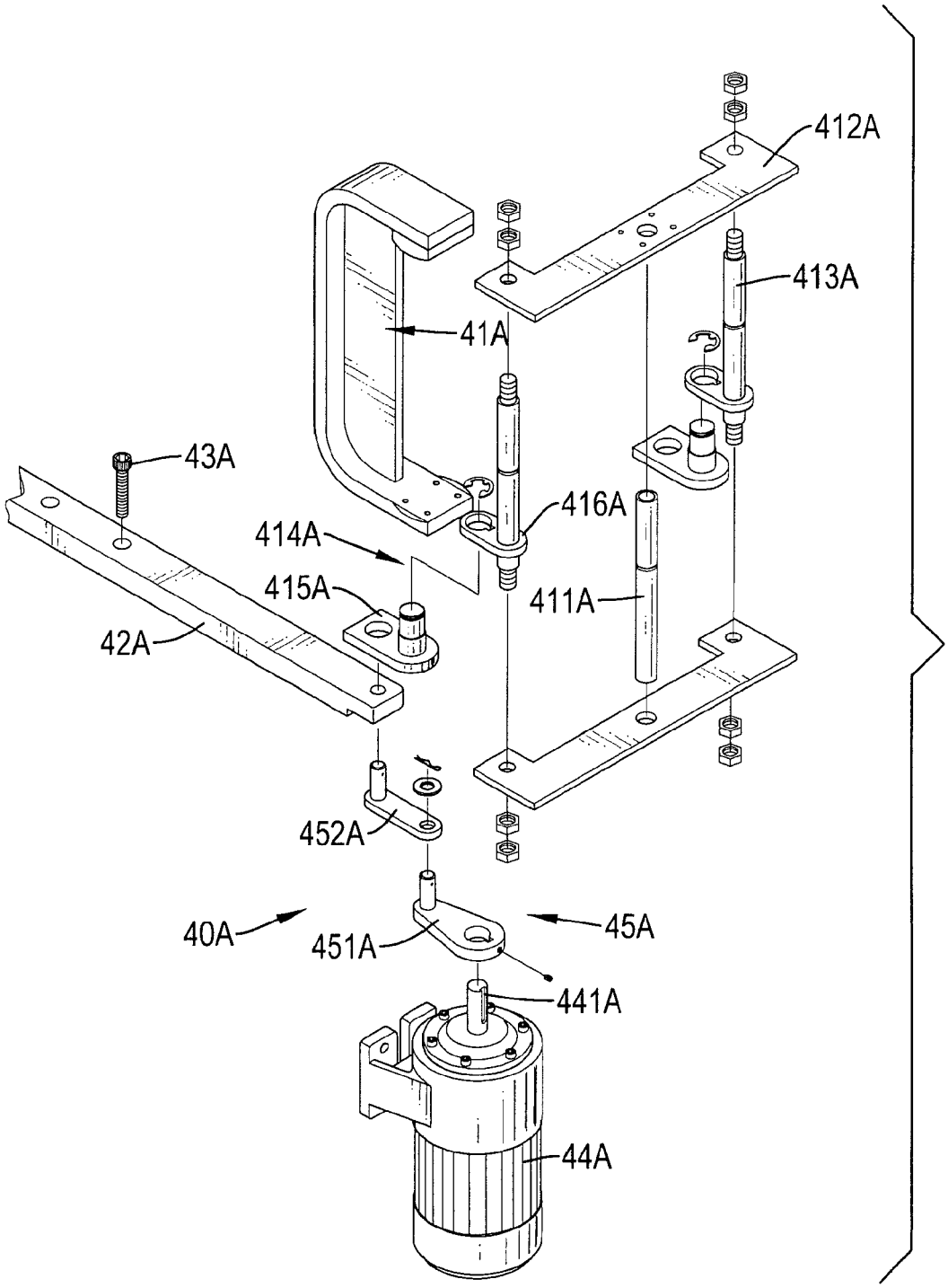
FIG. 7 is an exploded perspective view in partial section of a second embodiment of a reciprocating device of the linear sander in FIG. 1.

With further reference to FIG. 7, a second embodiment of a reciprocating device (40A) of the linear sander has a structure substantially same as that of the previous embodiment in FIG. 6, except that each couple (414A) of the pivot bracket (41A) is implemented as a connecting ring (416A) and a connecting panel (415A). The connecting ring (416A) of each couple (414A) is mounted around the guiding posts (413A). The connecting panel (415A) is connected to the connecting rings (414A).

Figure 8:
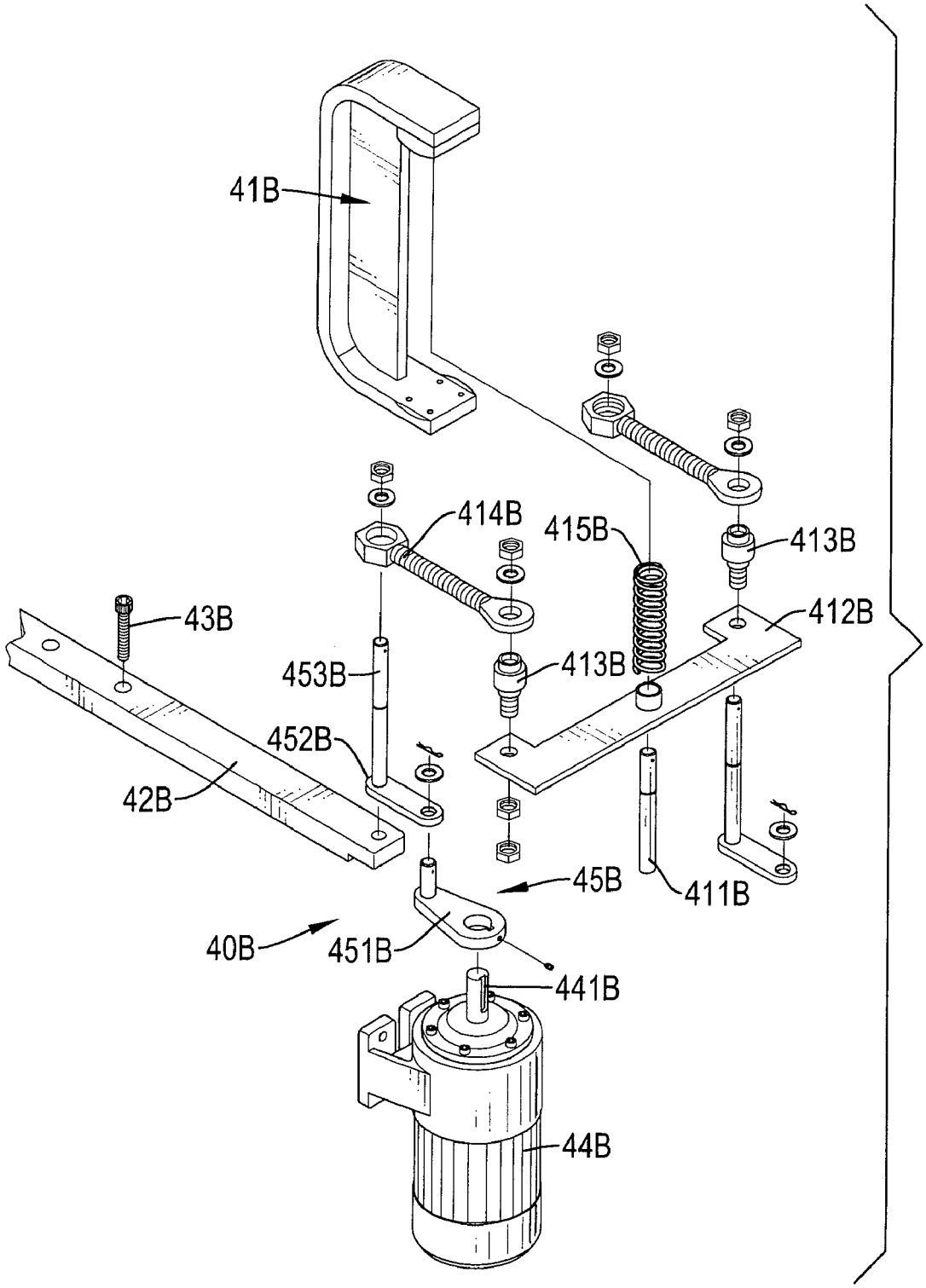
FIG. 8 is an exploded perspective view in partial section of another embodiment of reciprocating device of the linear sander in FIG. 1.

With further reference to FIG. 8, another embodiment of a reciprocating device (40B) of the linear sander has a structure substantially same as that of the previous embodiment except that the pivot bracket (41B) of the reciprocating device (40B) only has one pivot arm (412B) and further has a spring (415B) mounted around the pivot shaft (411B).

Figure 9:
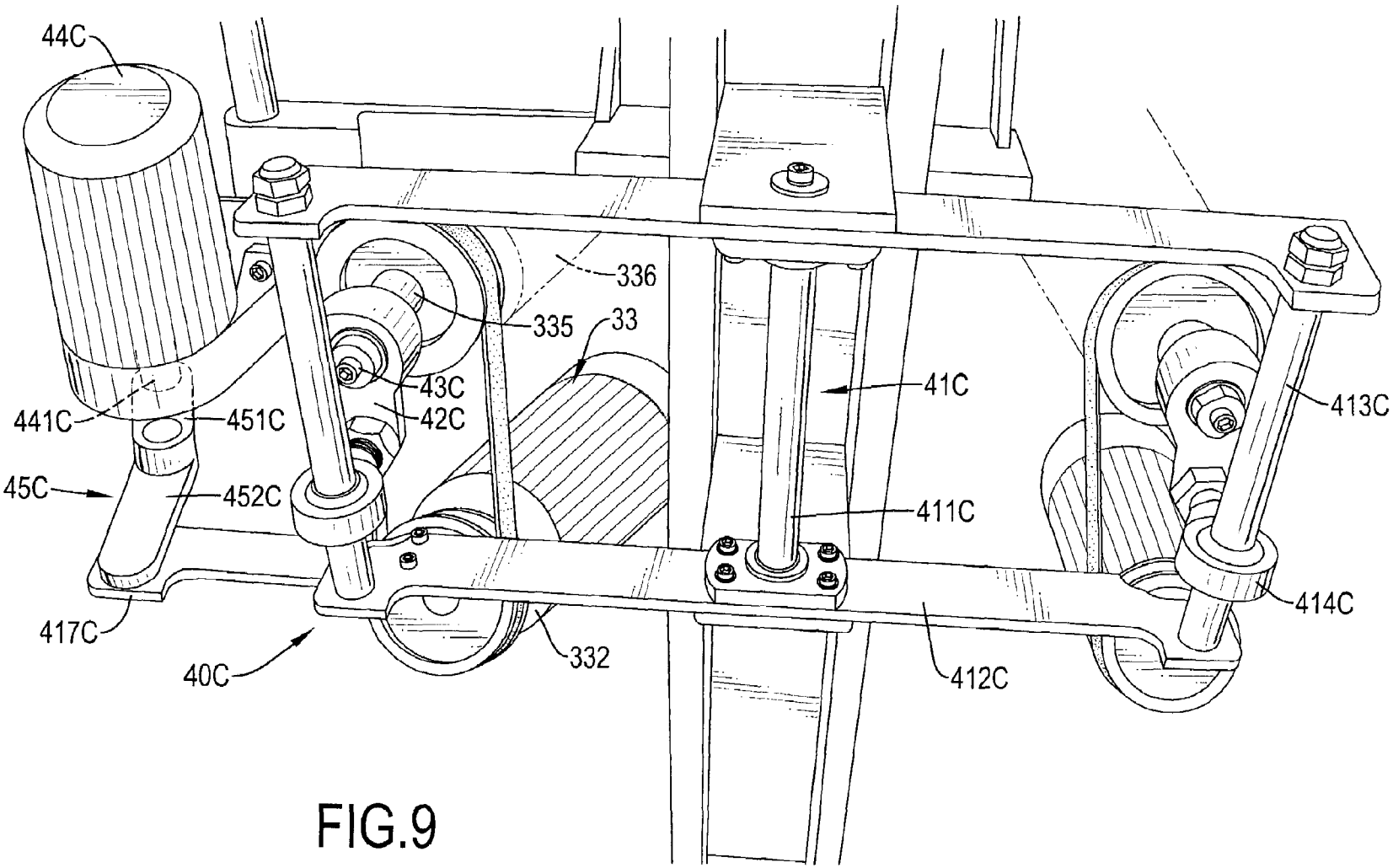
FIG. 9 is a perspective view in partial section of a further embodiment of reciprocating device of the linear sander in FIG. 1.

With further reference to FIG. 9, further embodiment of a reciprocating device (40C) of the linear sander has a structure substantially same as that of the previous embodiment except that the pivot bracket (41C) of the reciprocating device (40C) further has an extending arm (417C) mounted on one of the pivot arms (412C).

The drive bars (42, 42A, 42B, 42C) are respectively mounted securely on the bottoms of the base frames (331) of the abrasive rollers (33) between the mounting shafts (32) to slidably move the abrasive rollers (33) linearly along the mounting shafts (32) and each drive bar (42, 42A, 42B, 42C) has a driving end connected to the driving end of a corresponding couple (414, 414A, 414B, 414C). The connecting bolts (43, 43A, 43B, 43C) are respectively mounted through the drive bar (42, 42A, 42B, 42C) and in the base frames (331) of the abrasive rollers (33) to connect the drive bar (42, 42A, 42B) to the base frames (331).

The linear driver (44, 44A, 44B) is connected to the drive bar (42, 42A, 42B) and a corresponding couple (414, 414A, 414B) of the pivot bracket (41, 41A, 41B), may be mounted on the outer side of the corresponding mounting bracket (31) adjacent to the pivot bracket (41, 41A, 41B) and has a drive shaft (441, 441A, 441B, 441C). With further reference to FIG. 9, the linear driver (44C) is connected to the pivot arm (412C) that has the extending arm (417C).

The linking segment (45, 45A, 45B) is connected to the linear driver (44, 44A, 44B), the drive bar (42, 42A, 42B) and the corresponding couple (414, 414A, 414B) and has a crank (451, 451A, 451B) and a connecting rod (452, 452A, 452B). The crank (451, 451A, 451B) is connected to the drive shaft (441, 441A, 441B) of the linear driver (44, 44A, 44B). The connecting rod (452, 452A, 452B) is connected to the crank (451, 451A, 451B) and the driving ends of the drive bar (42, 42A, 42B) and the corresponding couple (414, 414A, 414B). The linear driver (44, 44A, 44B) moves the crank (451, 451A, 451B) that moves the connecting rod (452, 452A, 452B) and the drive bar (42, 42A, 42B) reciprocatorily to give the abrasive rollers (33) reciprocating motion along the mounting shafts (32).

With further reference to FIG. 9, the linking segment (45C) is connected to the linear driver (44C) and the extending arm (417C) and has a crank (451C) and a connecting rod (452C). The crank (451C) is connected to the drive shaft (441C) of the linear driver (44C). The connecting rod (452C) is connected to the crank (451C) and the extending arm (417C). The linear driver (44C) moves the crank (451C) that moves the connecting rod (452C), the extending arm (417C) and the corresponding pivot arm (412C) reciprocatorily to give the drive bar (42C) and the abrasive rollers (33) reciprocating motion.

With further reference to FIG. 7, one of the connecting panels (415A) is connected to the driving end of the drive bar (42A) and the connecting rod (452A) of the linking segment (45A).

With further reference to FIG. 8, the linking segment (45B) further has two connecting posts (453B) respectively formed on the connecting rods (452B) and connected to the driving ends of the couples (414B).

Figure 10:
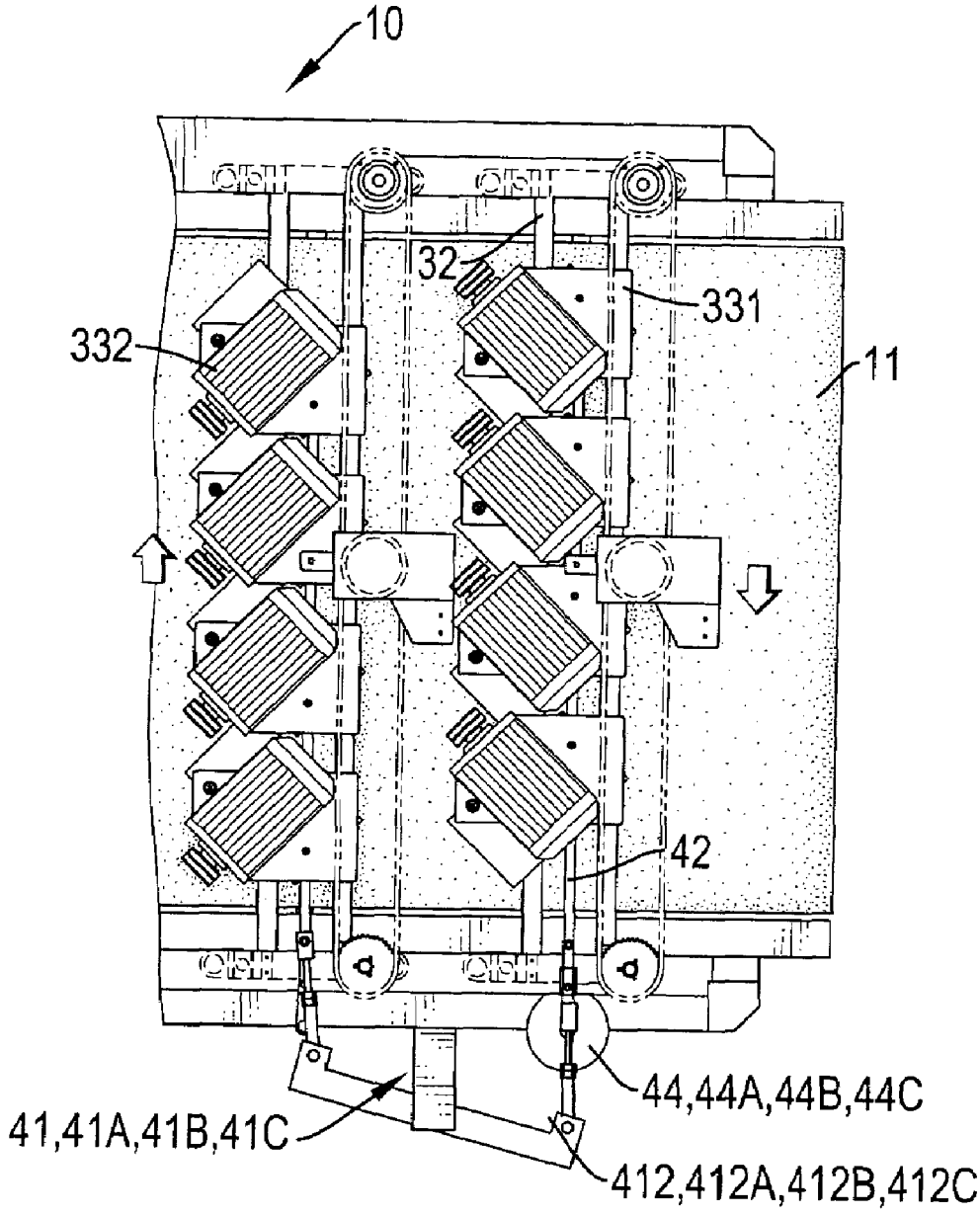
FIG. 10 is an operational top view in partial section of the reciprocating device of the linear sander in FIG. 2.

With further reference to FIG. 10, when the abrasive rollers (33) are rotated to sand surfaces of the article by the motors (332), the crank (451, 451A, 451B, 451C) and the connecting rod (452, 452A, 452B, 452C) of the linking segment (45, 45A, 45B, 45C) and the corresponding couple (414, 414B) or the connecting ring (414A) and the connecting panel (415A) or the extending arm (417C) will push one of the drive bars (42, 42A, 42B, 42C) to move along the corresponding mounting shaft (32) with a corresponding free end of the pivot arms (412, 412A, 412B, 412C) relative to the pivot shaft (411, 411A, 411B, 411C) and make the base frames (331) and the abrasive brushes (336) move linearly. At the same time, an other free end of the pivot arms (412, 412A, 412B, 412C) will pull an other drive bar (42, 42A, 42B, 42C) to move in an opposite direction to make a corresponding base frames (331) and abrasive brush (336) move linearly. As the abrasive rollers (33) are continuously rotated by the motors (332), the linking segment (45, 45A, 45B, 45C) will push and pull the drive bars (42, 42A, 42B, 42C) toward and away from the linear driver (44, 44A, 44B, 44C) to change location of the base frames (331) and the abrasive brushes (336) reciprocalorily to provide a preferred polishing effect.

Figure 11:
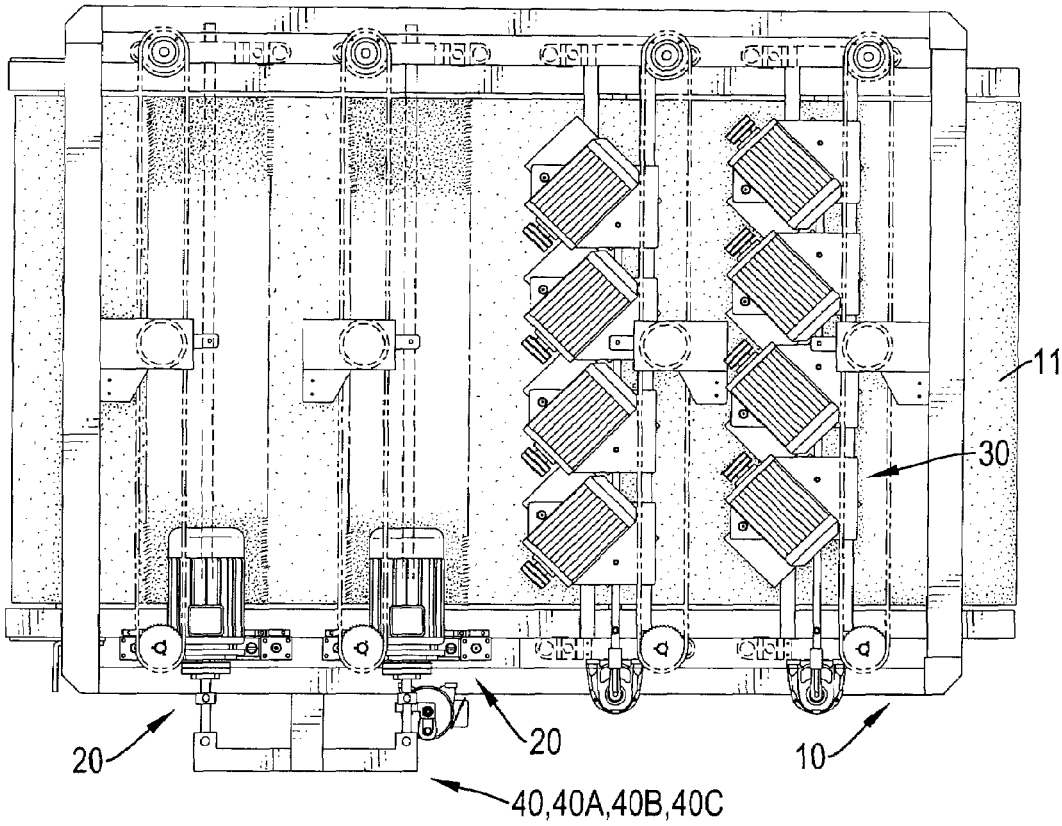
FIG. 11 is a top view of a second embodiment of a linear sander in accordance with the present invention.

With further reference to FIG. 11, the second embodiment of a linear sander in accordance with the present invention has a structure substantially same as that of the previous embodiment except that the reciprocating device (40, 40A, 40B, 40C) is connected to the rough abrasive assemblies (20) to push and pull the linking segments (45, 45A, 45B, 45C) toward and away from the crossbars (12) to change the location of the rotating axles (21) and the abrasive brushes (22) reciprocatorily and linearly.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A linear sander comprising a base having a top;

a bottom;

a front end;

a rear end;

two longitudinal sides;

at least four stanchions; and at least two crossbars respectively being mounted between two different stanchions on the longitudinal sides;

a conveyor belt being movably mounted in the base between the longitudinal sides; and a reciprocating device being movably connected to the base between two of the at least four stanchions and having a pivot bracket being mounted securely on the base near one of the at least one of the crossbars and having a top;

a bottom;

a pivot shaft being connected to the pivot bracket between the top and the bottom;

at least one pivot arm being respectively mounted rotatably and transversally on the top and the bottom of the pivot bracket, parallel to the crossbars of the base, being connected to the pivot shaft and each pivot arm having a middle being connected to the pivot bracket and the pivot shaft; and two free ends; and two guiding posts being securely connected to respectively to two free ends of the pivot arms, parallel to the pivot shaft.

2. The linear sander as claimed in claim 1, wherein the linear sander further has at least one rough abrasive assembly being rotatably mounted on the front end of the base above the conveyor belt and each one rough abrasive having an abrasive roller and each abrasive roller having a rotating axle being rotatably mounted between the inner sides of the stanchions above the conveyor belt; and an abrasive brush being mounted around the rotating axle of the abrasive roller; and at least one fine abrasive assembly being mounted on the rear end of the base above the conveyor belt and each one fine abrasive assembly having two mounting shafts, and each mounting shaft having two ends; and multiple abrasive rollers being slidably mounted and equi-spaced on the mounting shafts; and the reciprocating device being connected to one of the at least one rough and fine abrasive assemblies of the linear sander to move each abrasive roller of the corresponding abrasive assembly reciprocatorily and linearly.

3. The linear sander as claimed in claim 2, wherein each one of the at least one fine abrasive assembly further has two mounting brackets being mounted adjacent to the longitudinal sides of the base and each mounting bracket having an inner side;

an outer side; and a middle;

the mounting shafts of the at least one fine abrasive assembly being mounted parallelly on the middles of the mounting brackets; and each abrasive roller of the at least one fine abrasive assembly further has a base frame being slidably mounted on the mounting shafts between the mounting brackets of a corresponding one of the least one fine abrasive assembly and having a top; and a bottom;

a motor being securely mounted on the top of the base frame and aligned obliquely to the mounting shafts of the corresponding fine abrasive assembly;

an axle mount being mounted on the bottom of the base frame and having a free end;

a rotating axle being rotatably mounted through the free end of the axle mount, mounted above the conveyor belt and having a drive end being rotated by the motor; and a central segment; and an abrasive brush being mounted around the central segment of the rotating axle.

4. The linear sander as claimed in claim 3, wherein the pivot bracket further has two couples being respectively mounted around the guiding posts and each couple having a mounting end being mounted around a corresponding guiding post; and a driving end; and the reciprocating device further has two drive bars being securely and respectively mounted securely on the bottoms of the base frames of the abrasive rollers between the mounting shafts of the corresponding abrasive assembly to slidably move the abrasive rollers linearly along the mounting shafts and each drive bar having a driving end connected to the driving end of one of the couples; and a linear driver being connected to the drive bar and one of the couples of the pivot bracket and having a drive shaft.

5. The linear sander as claimed in claim 3, wherein the reciprocating device further has two drive bars being respectively mounted securely on the bottoms of the base frames of the abrasive rollers between the mounting shafts of a corresponding one of the at least one rough and fine abrasive assemblies to slidably move the abrasive rollers linearly along the mounting shafts and having a driving end;

a linear driver being connected to the drive bar and having a drive shaft;

a linking segment being connected to the linear driver and the drive bar and having a crank being connected to the drive shaft of the linear driver; and a connecting rod being connected to the crank and the driving end of the drive bar; and the pivot bracket further has two pivot arms being respectively mounted rotatably and transversally on the top and the bottom of the pivot bracket, parallel to the crossbars of the base, being connected to the pivot shaft and each pivot arm; and two couples each comprising a connecting ring being mounted around one guiding post; and a connecting panels being connected to the connecting ring, wherein one of the connecting panels is connected to the driving end of the drive bar and the connecting rod of the linking segment.

6. The linear sander as claimed in claim 3, wherein the pivot bracket further has two couples being respectively mounted around the guiding posts and each couple having a mounting end being mounted around a corresponding guiding post; and a driving end; and a spring being mounted around the pivot shaft; and the reciprocating device further has two drive bar being respectively mounted securely on the bottoms of the base frames of the abrasive rollers of the at least one fine abrasive assembly between the mounting shafts to move the abrasive rollers linearly along the mounting shafts of the at least one fine abrasive assembly and having a driving end connected to the driving end of one of the couples;

a linear driver being connected to the drive bar and a corresponding couple of the pivot bracket and having a drive shaft; and a linking segment being connected to the linear driver and the drive bar and having a crank being connected to the drive shaft of the linear driver;

a connecting rod being connected to the crank; and a connecting post being formed on the connecting rod and being connected to the driving end of a corresponding couple.

7. The linear sander as claimed in claim 3, wherein the pivot bracket further has two couples being respectively mounted around the guiding posts and each couple having a mounting end being mounted around a corresponding guiding post; and a driving end; and an extending arm being mounted on one of the pivot arms;

the reciprocating device further has two drive bars being securely and respectively mounted securely on the abrasive rollers to slidably move the abrasive rollers linearly and each drive bar having a driving end connected to the driving end of one of the couples;

a linking segment being connected to the linear driver and the extending arm and having a crank being connected to the drive shaft of the linear driver; and a connecting rod being connected to the crank and the extending arm; and a linear driver being connected to the corresponding pivot arm that mounted with the extending arm and having a drive shaft.

8. The linear sander as claimed in claim 3, wherein each one of the at least one fine abrasive assembly further has two clearance adjustors being connected to the base and respectively to the fine abrasive assembly at the ends of the mounting shafts to allow the fine abrasive assembly to be moved perpendicularly relative to the conveyor belt and each clearance adjustor having a guide frame being mounted on one side of the base and through a corresponding mounting bracket of the fine abrasive assembly and having two guiding shafts being vertically and securely mounted on the side of the base and through the corresponding mounting bracket and each guiding shaft being connected to one of the crossbars of base and having a distal end; and a stopping block being mounted on the guiding shafts to limit movement of the mounting bracket along the guiding shafts and mounted between the distal ends of the guiding shafts;

an adjustor shaft being mounted securely on the mounting bracket, parallel to the guiding shafts and having a connecting end being mounted securely on the mounting bracket;

a distal end; and an external thread being formed around the adjustor shaft near the distal end; and an adjustor pulley being rotatably mounted on the distal end of the adjustor shaft, engaging the external thread of the adjustor shaft, and having an annular surface and multiple teeth being formed on the annular surface; and an adjustor driver being mounted on the top of the base between the guide frames and being connected to the adjustor pulleys by a chain engaging the teeth of the adjustor pulleys.

9. The linear sander as claimed in claim 8, wherein two fine abrasive assemblies are mounted on the rear end of the base and are rotated in opposite directions;

the mounting brackets of each fine abrasive assembly are connected movable on the crossbars of the base;

each abrasive roller further has a bearing being mounted in the free end of the corresponding axle mount and the drive end of the corresponding rotating axle being mounted through the bearing; and each abrasive brush of each fine abrasive assembly is a sand cloth.

10. The linear sander as claimed in claim 9, wherein the reciprocating device further has multiple connecting bolts respectively mounted through the drive bars and in the base frames of the abrasive rollers of a corresponding one of the at least one rough and fine abrasive assemblies to connect the drive bars with the base frames.

11. The linear sander as claimed in claim 10, wherein the pivot bracket of the reciprocating device being U-shaped; and the linear driver is mounted on the outer side of the corresponding mounting bracket adjacent to the pivot bracket.

12. The linear sander as claimed in claim 11, wherein the reciprocating device further has a linking segment being connected to the linear driver, the drive bar and one of the couples and having a crank being connected to the drive shaft of the linear driver; and a connecting rod being connected to the crank and the driving ends of the drive bar and a corresponding couple.

* * * * *